US006509690B2

(12) United States Patent
Sempel et al.

(10) Patent No.: US 6,509,690 B2
(45) Date of Patent: Jan. 21, 2003

(54) DISPLAY DEVICE

(75) Inventors: Adrianus Sempel, Eindhoven (NL); Iain Mcintosh Hunter, Brighton (GB); Mark Thomas Johnson, Eindhoven (NL); Edward Willem Albert Young, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 09/847,214

(22) Filed: May 2, 2001

(65) Prior Publication Data

US 2002/0027422 A1 Mar. 7, 2002

(30) Foreign Application Priority Data

May 22, 2000 (EP) ..... 00201799

(51) Int. Cl.[7] ..... G09G 3/00
(52) U.S. Cl. ..... 315/169.3
(58) Field of Search ..... 315/169.1, 169.2, 315/169.3; 345/76, 77, 82, 84, 55

(56) References Cited

U.S. PATENT DOCUMENTS

| | | | | |
|---|---|---|---|---|
| 5,990,629 A | | 11/1999 | Yamada et al. | 315/169.3 |
| 6,072,450 A | * | 6/2000 | Yamada et al. | 313/500 |
| 6,091,382 A | * | 7/2000 | Shioya et al. | 345/76 |
| 6,094,243 A | * | 7/2000 | Yasunishi | 345/100 |
| 6,288,695 B1 | * | 9/2001 | Wood | 345/75.2 |
| 6,337,673 B1 | * | 1/2002 | Ide et al. | 345/60 |
| 6,339,415 B2 | * | 1/2002 | Ishizuka | 345/76 |
| 6,346,774 B1 | * | 2/2002 | Tamai et al. | 315/169.1 |
| 6,356,029 B1 | * | 3/2002 | Hunter | 315/169.1 |

FOREIGN PATENT DOCUMENTS

EP 1061497 A1 6/2000

* cited by examiner

*Primary Examiner*—Don Wong
*Assistant Examiner*—Minh D A

(57) ABSTRACT

Grey scale linearity and power efficiency in active matrix (O) LEDs are enhanced by operating the display in a switched mode.

7 Claims, 3 Drawing Sheets

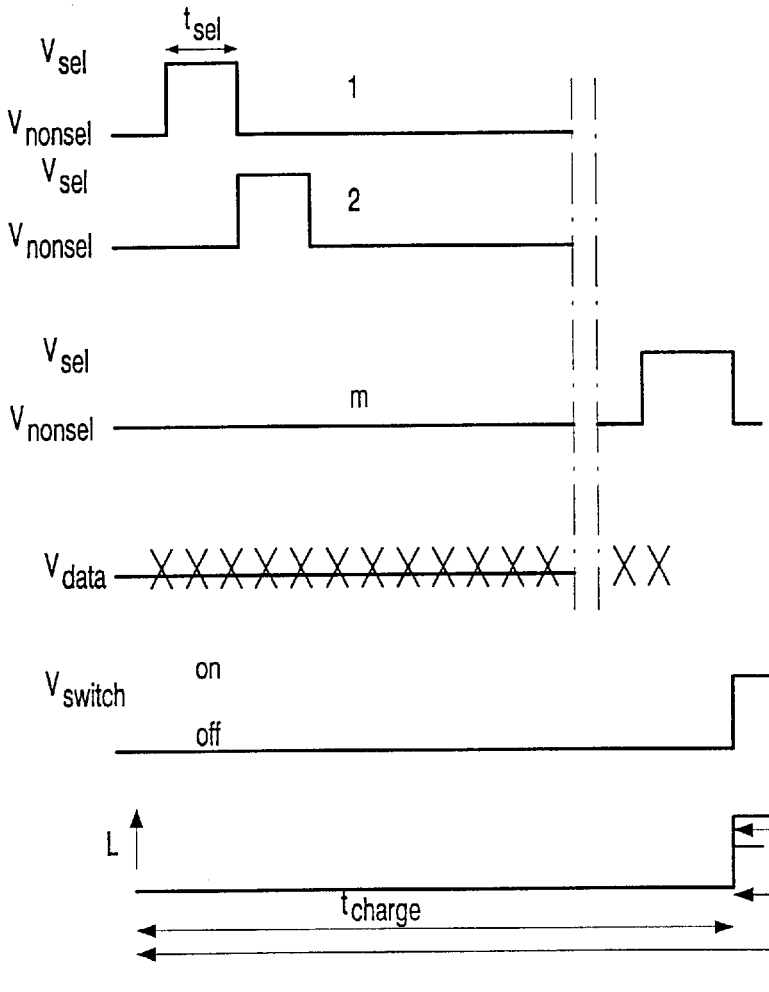
FIG. 4a
FIG. 4b
FIG. 4c
FIG. 4d
FIG. 4e
FIG. 4f
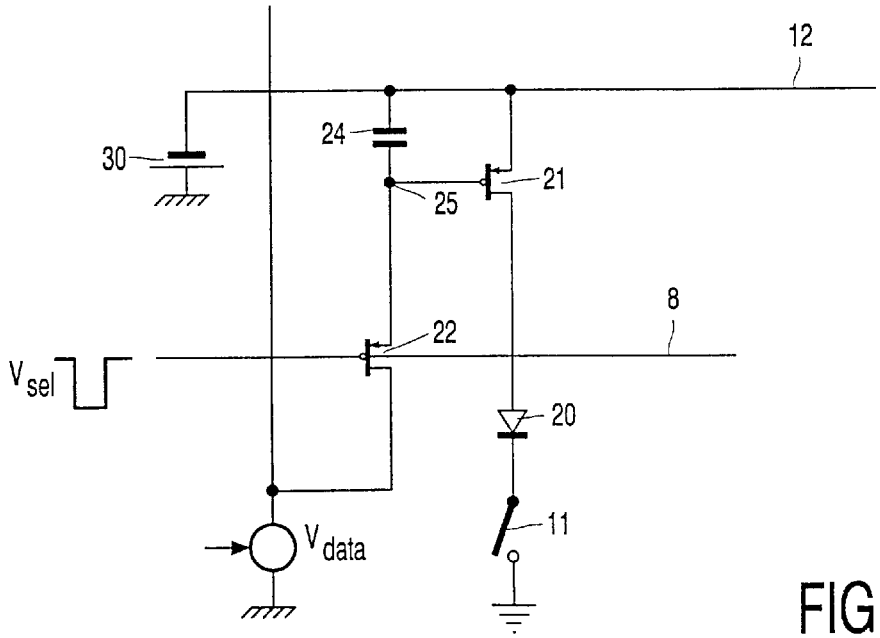
FIG. 5

DISPLAY DEVICE

BACKGROUND OF THE INVENTION

1 Field of the Invention

The invention relates to a display device comprising a matrix of pixels at the area of crossings of row and column electrodes, each pixel comprising at least a current adjusting circuit based on a memory element, in series with a luminescent element.

2 Description of Related Arts

Such electroluminescence-based display devices are increasingly based on (polymer) semiconducting organic materials. The display devices may either luminesce via segmented pixels (or fixed patterns) but also display by means of a matrix pattern is possible. The adjustment of the pixels via the memory element determines the intensity of the light to be emitted by the pixels. Said adjustment by means of a memory element, in which extra switching elements are used (so-called active drive) finds an increasingly wider application.

Suitable fields of application of the display devices are, for example, mobile telephones, organizers, etc.

A display device of the type described in the opening paragraph is described in PCT WO 99/42983. In said document, the current through a LED is adjusted by means of two TFT transistors per pixel in a matrix of luminescent pixels; to this end, a charge is produced across a capacitor via one of the TFT transistors. This TFT transistor and the capacitor constitute a memory element. After the first TFT transistor has been turned off, the charge of the capacitor determines the current through the second TFT transistor and hence the current through the LED. At a subsequent selection, this is repeated.

In this drive mode, the LED conveys current also during non-selection, which is at the expense of dissipation and results in faster ageing. Moreover, artefacts occur in moving images.

BRIEF SUMMARY OF THE INVENTION

It is, inter alia, an object of the present invention to provide a display device of the type described in the opening paragraph in which the above-mentioned problems occur to a lesser extent. To this end, such a display device is characterized in that the display device comprises at least one independently switchable switch in the current path of the current adjusting circuit and the luminescent element.

By means of the switch (for example, a TFT transistor or a bipolar transistor), the luminescent elements are provided with a current corresponding to the desired luminance. The adjustment of a part of the drive circuit takes place prior to closing of the switch. Parts of this drive circuit (particularly the combination of a capacitor and a transistor associated with the memory element) are used both for pre-adjustment of a drive value and for determining the ultimate current through the luminescent elements. Since the luminescent elements can now convey current for a much shorter time, they are preferably but not necessarily driven in the so-called constant efficiency range. Here, the efficiency of the LED as a function of the diode voltage is practically constant and the quantity of emitted light is practically linearly proportional to the current through the LED. This provides the possibility of accurately adjusting grey values with a high efficiency so that a short drive pulse of the LEDs is sufficient.

In a first embodiment, the display device comprises at least a switch in the current path of the current adjusting circuit and the luminescent element. This, however, requires one switch per pixel and is at the expense of the aperture. For this reason, a preferred embodiment is characterized in that the switch is present between a plurality of luminescent elements and a connection point for an operating voltage.

These and other aspects of the invention are apparent from and will be elucidated with reference to the embodiments described hereinafter.

BRIEF DESCRIPTION OF THE DRAWINGS

In the drawings:

FIG. 3 shows transistor characteristics of transistors used in FIG. 1, while FIG. 4 shows an associated time diagram, and FIG. 5 shows a further variant.

The Figures are diagrammatic; corresponding components are generally denoted by the same reference numerals.

DETAILED DESCRIPTION OF THE INVENTION

Figure 1:
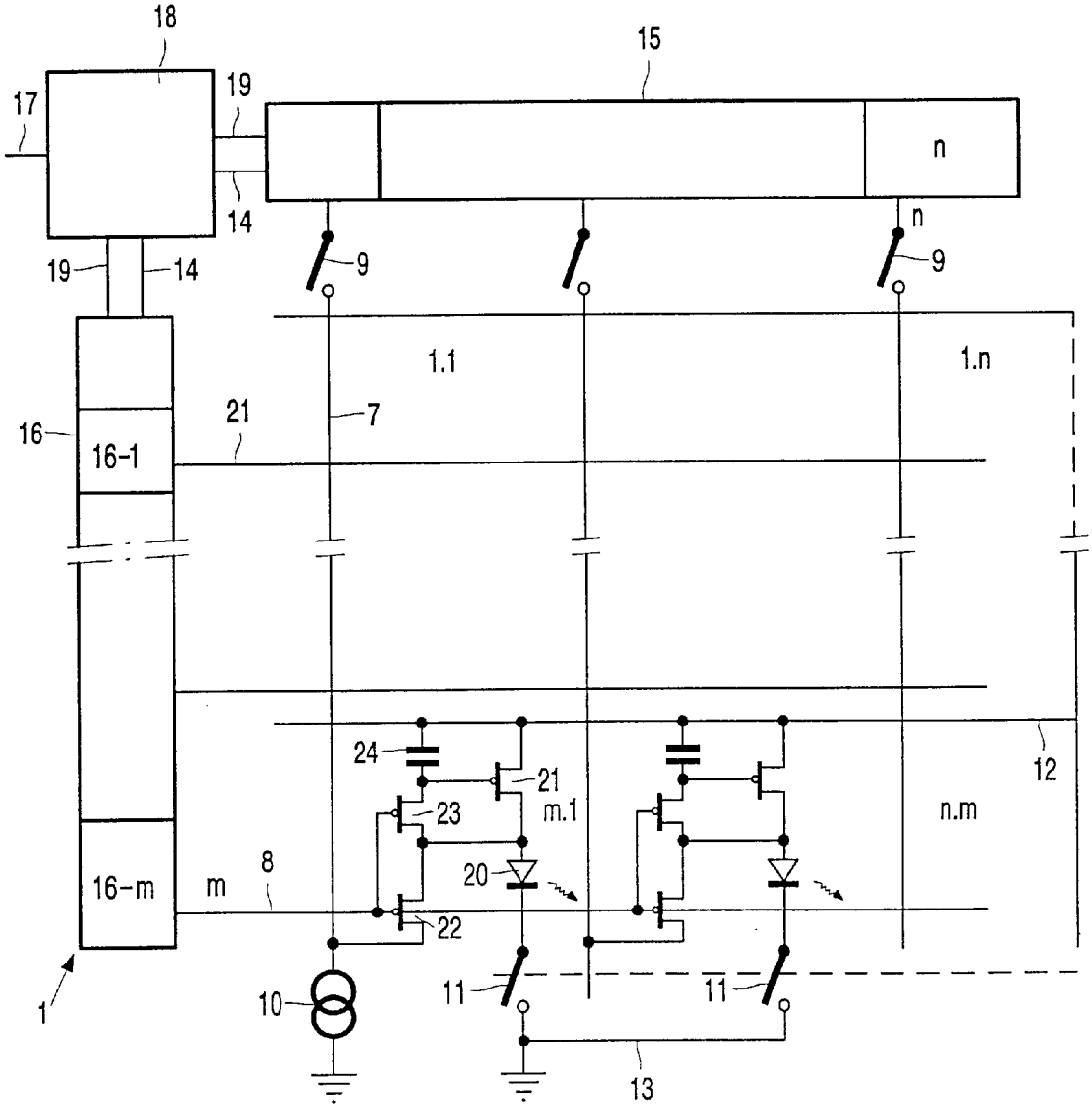
FIG. 1 shows diagrammatically a display device according to the invention.

FIG. 1 shows diagrammatically an equivalent circuit diagram of a part of a display device 1 according to the invention. This display device comprises a matrix of (P) LEDs or (O) LEDs 14 with n rows (1, 2, . . . , n) and m columns (1, 2, . . ., m). Where rows and columns are mentioned, they may be interchanged, if desired. This device further comprises a row selection circuit 16 and a data register 15. Externally presented information 17, for example, a video signal, is processed in a processing unit 18 which, dependent on the information to be displayed, charges the separate parts 15-1, . . . , 15-n of the data register 15 via supply lines 19.

The selection of a row takes place by means of the row selection circuit 16 via the lines 8, in this example, gate electrodes of TFT transistors or MOS transistors 22, by providing them with the required selection voltage.

Writing data takes place in that, during selection, the current source 10, which may be considered to be an ideal current source, is switched on by means of the data register 15, for example, via switches 9. The value of the current is determined by the contents of the data register. The current source 10 may be common for a plurality of rows. If this is not the case, the switches 9 may be dispensed with. Where this application states the phrase "can be electrically coupled to the current source", this case is also considered to be included.

During addressings, the capacitor 24 is provided with a certain charge via the transistors 21, 22 and 23. This capacitor determines the adjustment of the transistor 21 (and constitutes said memory circuit therewith) and hence the actual current through the LED 20 during the drive period, and the luminance of (in this example) the pixel (n,1), as will be described hereinafter. Mutual synchronization between the selection of the rows 8 and the presentation of voltages to the columns 7 takes place by means of the drive unit 18 via drive lines 14.

At the instant when a row, in this example row 1, is selected, the current source 10 starts to convey current. During selection, information is presented from column register 15 (in this example) via the line 7. This information determines the current through the (adjusting) transistors 21, 22 and 23 so that the capacitor 24 acquires a given charge, dependent on the conveyed current and the period of time. The other plate of the capacitor 24 is connected to the positive power supply line 12. After selection (after closure of the switch 22), this capacitor has a certain charge which determines the voltage at the gate of (control) transistor 21. According to the invention, the diode (LED) 20 does not start conducting until after all pixels have been adjusted, i.e. when all transistors 21 have been adjusted in a similar manner. At that instant (at the end of a frame time), a common switch 11 between one or more LEDs 20 and, for example, ground (in this example via the line 13) is closed for a short time so that current can flow through the transistors 21 and the LEDs 20 so that the LEDs luminesce in conformity with the adjusted value. The switch may also be closed after a part of the number of lines (½, 1/4, . . . ) has been written (referred to as sub-frame driving).

Figure 2:
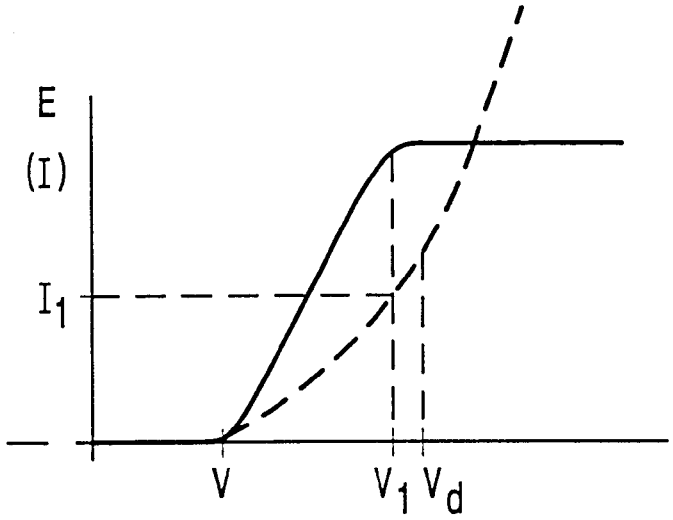
FIG. 2 shows the efficiency and the current through a LED as a function of the voltage.

The advantage thereof will be described with reference to FIG. 2. This Figure shows, as a function of the voltages across a LED, the (logarithm of the) efficiency (solid line) of the LED and the current (broken line) through the LED. The Figure shows that this efficiency reaches a given maximum from a voltage $V_1$. The current through the LEDs (and hence the luminance) increases substantially exponentially from $V_1$. Since one or more switches 11 are short-circuited, the desired quantity of light can be emitted for a short time with a high efficiency and a short current pulse.

Figure 3:
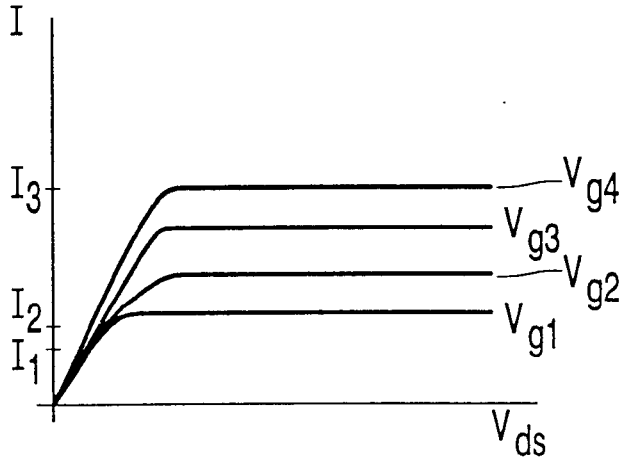

The adjustable currents preferably have such values that they are practically always larger than the current $I_1$ (FIG. 2) associated with the voltage $V_1$. To this end, the transistor 21 has a characteristic as is shown in FIG. 3. In this embodiment, transistor 21 is a TFT transistor of the p type which, dependent on the gate voltages $V_{g1}$–$V_{g4}$ supplies currents between $I_2$ and $I_3$ (FIG. 3), which currents are larger than $I_2$, while the range $I_2$–$I_3$ is sufficiently wide to adjust all grey values in the high efficiency range. The linear current behavior of the (O) LEDs in this range renders a simple adjustment of grey values possible.

The operation of the display device is explained once more with reference to FIGS. 1 and 4. By switching on current sources 10 associated with columns 1 to m (FIG. 4(*d*)) during consecutive selection of the rows 1 to n (FIGS. 4(*a*), 4(*b*), 4(*c*)), a capacitor 24 is provided with a certain charge in each of the pixels. The information as stored in data register 15 determines, in a way similar to that described above, the current through transistors 21, 22 and 23. The voltage on the supply line 12 is such that one plate of the capacitor and hence node 25 receives a voltage in the range $V_{g1}$–$V_{g4}$, which voltage is maintained after the current source 10 has been switched off.

The voltage at the node 25 and hence the voltage at the gate of transistor 21 is in the range $V_{g1}$–$V_{g4}$. However, the transistor 21 cannot conduct because the switch 11 is opened. This switch is not closed until after the end of the frame period $t_F$ after the period $t_{charge}$ in which all pixels are charged. The switch 11 is closed, for example, for a short period $t_{switch}$, which period is long enough to cause the associated diodes (LED) 20 to luminesce in the correct adjustment. Since all (desired) LEDs are on for a short time with a higher efficiency, there is less degradation in this drive mode than in the customary passive and active structures.

By means of a drive circuit (not shown) the duty cycle $$\frac{t_{switch}}{t_f}$$

of the switch is adjusted, if desired, as a function of temperature or ageing, such that the efficiency remains substantially constant (optimal). It is also possible to choose the duty cycle to be different per color (in a color display device) and thus to obtain an optimal color point.

The switch 11 is preferably realized in monocrystalline silicon. In this way, a large current required for driving the total number of pixels can be supplied rapidly. This switch may be realized, for example, in a drive IC. Use may also be made of some parallel switches.

FIG. 5 shows a variant in which the voltage across the capacitor is adjusted by means of voltage control. The voltage across the capacitor 24 (and hence the adjustment of the LED 20) is now dependent on the voltages from the voltage sources 30, 31 ($V_{data}$) and the data voltage $V_{sel}$.

Several variations are of course possible within the scope of the invention. In given applications, not all pixels need to be adjusted in advance before the LED drive is started. A realization with bipolar transistors is also feasible.

The protective scope of the invention is not limited to the embodiments described. The invention resides in each and every novel characteristic feature and each and every combination of features. Reference numerals in the claims do not limit the protective scope of these claims. The use of the verb "to comprise" and its conjugations does not exclude the presence of elements other than those stated in the claims. The use of the article "a" or "an" preceding an element does not exclude the presence of a plurality of such elements.

What is claimed is:

1. A display device comprising:

a matrix of pixels at the area of crossings of row and column electrodes, each pixel comprising:

a current adjusting circuit, and a luminescent element, and at least one switch in the current path of the current adjusting circuit and the luminescent element, wherein the current adjusting circuit of each pixel is configured to provide a current that corresponds to a gray scale level of the luminescent element of the pixel, based on a value of a corresponding memory element.

2. The display device as claimed in claim 1, wherein the at least one switch is arranged between the memory element and the luminescent element.

3. The display device as claimed in claim 1, wherein the at least one switch is arranged between a plurality of luminescent elements and a source voltage.

4. The display device as claimed in claim 1, further including at least one other switch that is configured to operably couple the memory element and the current adjusting circuit.

5. The display device as claimed in claim 1, further including a driver that is configured to vary a time during which the at least one switch is closed.

6. The display device as claimed in claim 5, wherein the driver is configured to drive luminescent elements of different color during different periods of time.

7. The display device as claimed in claim 1, wherein the luminescent element comprises an organic LED or a polymer LED.

* * * * *